US008337061B2

(12) United States Patent
Kaak et al.

(10) Patent No.: US 8,337,061 B2
(45) Date of Patent: Dec. 25, 2012

(54) ILLUMINATING DEVICE FOR VEHICLES

(75) Inventors: Oliver Kaak, Paderborn (DE); Juergen Higgen, Salzkotten (DE); Frank Johannsmann, Rietberg (DE)

(73) Assignee: Hella KGaA Hueck & Co., Lippstadt (DE)

( * ) Notice: Subject to any disclaimer, the term of this patent is extended or adjusted under 35 U.S.C. 154(b) by 217 days.

(21) Appl. No.: 12/672,903

(22) PCT Filed: Jul. 24, 2008

(86) PCT No.: PCT/DE2008/001209

§ 371 (c)(1),
(2), (4) Date: Feb. 16, 2010

(87) PCT Pub. No.: WO2009/021482

PCT Pub. Date: Feb. 19, 2009

(65) Prior Publication Data

US 2010/0202151 A1 Aug. 12, 2010

(30) Foreign Application Priority Data

Aug. 10, 2007 (DE) ..... 20 2007 011 255 U

(51) Int. Cl.
*F21V 7/00* (2006.01)

(52) U.S. Cl. ..... 362/516; 362/37; 362/514; 362/459

(58) Field of Classification Search ..... 362/37–60, 362/459–549, 317, 327, 328, 341, 609, 623, 362/624, 625, 627, 215, 217.05, 235, 241, 362/243, 245, 247, 296.01
See application file for complete search history.

(56) References Cited

U.S. PATENT DOCUMENTS 6,441,943 B1 * 8/2002 Roberts et al. ..... 359/267
2002/0191196 A1 * 12/2002 Bossche ..... 356/614

* cited by examiner

*Primary Examiner* — Danielle Allen
(74) *Attorney, Agent, or Firm* — Patent Central LLC; Stephan A. Pendorf

(57) ABSTRACT

An illuminating device for vehicles, in particular a tail light, with a housing containing at least one light source, a support accommodating the light source, and a reflector, and with a diffusion lens for covering an opening of the housing. The reflector, which is provided with an electrically conductive coating, is assigned charge dissipation path in such a manner that, when electrostatic charging of the reflector occurs, a dissipation current flows along the dissipation path to a connection to earth of the illuminating device.

11 Claims, 2 Drawing Sheets

ILLUMINATING DEVICE FOR VEHICLES

BACKGROUND OF THE INVENTION

1. Field of the invention

The invention relates to an illuminating device for vehicles, in particular a tail light, with a housing containing at least one light source, a support accommodating the light source and a reflector, and with a diffusion lens for covering an opening of the housing.

2. Description of the Related Art

Prior known from DE 10 2006 001 363 A1 is an illuminating device for vehicles with a housing containing a plurality of light sources. Part of these light sources on the one hand are provided in the form of light elements (LEDs) which are arranged on a common light element carrier. A reflector is disposed ahead of said light element carrier as viewed in main beam direction to conduct light emitted by said elements. Disposed inside the housing on the other hand is a different type of light source, i.e. an incandescent bulb, which serves to generate a different light mode or function. The housing which is open at its forward end in main beam direction is covered with a diffusion lens. It has been found that that electrostatic discharges (ESD) from a charged illuminating device may be caused via a printed board when contacting the illuminating device such as in case of lamp assembly or during installation of the device into the vehicle with the consequence that relatively high impulsive currents may flow along the printed board and lead to destruction of electric components. Electrostatic charge buildup primarily occurs at the metal coated reflector. A common potential will not be established in all areas of the illuminating device components until the device has been finally mounted to the vehicle and the battery cable has been connected to said latter.

BRIEF SUMMARY OF THE INVENTION

It is an object of this present invention to improve an illuminating device for vehicles in such a way that during installation thereof into a body shell aperture of a vehicle, in particular while electrically connecting the illuminating device to the onboard electrical system, the functional ability and performance of any electrical components fitted to a support will be maintained.

To achieve this goal, the invention is characterized by the fact that charge dissipation means are assigned to the metal coated reflector such that whenever a electrostatic charge occurs in the reflector it will be caused to flow to an earth connection of the illuminating device.

Such charge dissipation means of this present invention ensure controlled discharge of transient and relatively high electric currents towards an earth connection of the illuminating device. Potential differences liable to occur between a reflector and a car body during installation of the illuminating device into a body shell aperture are compensated by the charge dissipation means such that no electrical components of a control system that are mounted on a support of the illuminating device, for instance transistors, diodes or such like, may get damaged or destroyed. These electrical components may for instance be used for such purposes as diagnosis, overvoltage protection or activation of light emission diodes.

A charge dissipation means proposed in a preferred embodiment of the invention is a charge conductive path having a first end in direct contact with the reflector and a second end in direct contact with an earth connection of the support or a central plug connector arrangement of the illuminating device. A controlled charge dissipation from an electricostatically charged reflector can be preferably achieved this way in bypassing electrically conductive surfaces of the support. Reflectors in the meaning of this invention are any and all plastic surfaces which are apt to get electrostatically charged and which are disposed in contact with or close to a light source support.

The charge dissipation path of this present invention may also serve to improve the electromagnetic compatibility of the illuminating device. Electromagnetic interferences which act on the printed board and which are liable to create undefined conditions on components of the support such as the glimmering of LEDs or the turning on of transistors are inhibited due to the fact that electric current can be discharged in a controlled mode.

A preferred embodiment of the invention provides for electrical and mechanical coupling of the charge dissipation path with the reflector via a spring contact and/or a plug connector element. This preferably ensures on the one hand a safe electrical connection and on the other hand a relatively simple mechanical coupling between the reflector and the charge dissipation path.

According to a first embodiment of the invention may the charge dissipation path be integrated in a lamp carrier for accommodating a plurality of incandescent bulbs for one light function. The charge dissipation path may be a separate dissipation conductor together with a plurality of further electric conductors in the form of a lamp carrier pressed screen. This means that controlled charge dissipation may be achieved within the lamp carrier for electrostatic discharge.

Another embodiment of the invention provides for the charge dissipation path to be in the form of a current discharging track which is integrated in a printed board type support for light elements. The advantage afforded by this arrangement is that the charge dissipation path may be provided as a compact unit and at low cost.

According to an improvement of the invention the first end of the current discharging track is in form of a land disposed in the area of a fixing bore for the printed board. Advantageously, a fixing element provided for attaching the printed board to the reflector may be contacted with said current discharging track in the area of said fixing bore such that coupling between the charge dissipation path on the one hand and the reflector on the other hand may be established without there being need for any extra mechanical and electrical connecting means. Assembly may be advantageously facilitated this way.

Further advantages of the invention are as defined in the subclaims.

BRIEF DESCRIPTION OF THE SEVERAL VIEWS OF THE DRAWINGS

Exemplary embodiments of the invention will now be described with reference to the accompanying drawings in which.

An illuminating device for vehicles of this present invention is preferably a tail light arranged in a body shell aperture of a vehicle together with a housing.

A support disposed inside the housing is on the one hand a lamp carrier 1 with a plurality of light sources in the form of incandescent bulbs 2 to generate a first light function such as a tail, turn or backup light signal, and on the other hand a light element carrier 3 in the form of a printed board accommodating a plurality of light elements 4 (LEDs). Said LED elements 4 serve for a different light mode such as generating a brake light signal.

A forward housing aperture as viewed in the main direction H of the light bundle produced by the illuminating device is covered with a diffusion lens.

Figure 2:
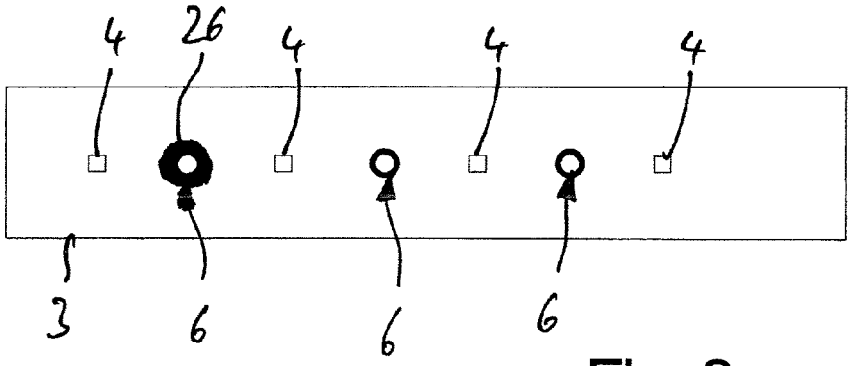
FIG. 2 is a top view of a light element carrier.

As will be seen from FIG. 2, the printed board 3 is an elongate strip wherein the LED light elements 4 are arranged in rows and in a spaced-apart relation. Fixing bores 6 are provided intermediately of said LED elements 4 for fixing screws 7 to engage in to attach the printed board 3 to a reflector 8 which as viewed in main beam direction H is arranged at back of said printed board 3. The reflector 8 is for this purpose provided with fixing means in the form of protruding fixing pads 9 which are in contact with a rear face of the printed board 3 and in threaded engagement with the fixing screw 7, see FIG. 4.

Figure 1:
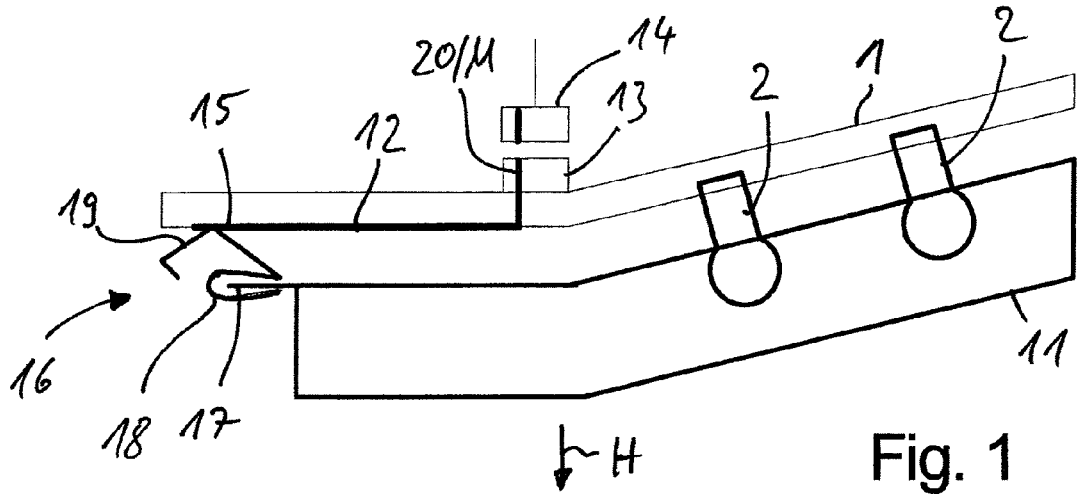
FIG. 1 is a partial vertical section through an illuminating device in an area in which a lamp carrier with a charge dissipation path according to a first embodiment is disposed.

As will be seen from FIG. 1, another reflector 11 is fitted ahead of the lamp carrier 1 as viewed in main beam direction H to conduct the light emitted by the incandescent bulbs 2. The reflectors 8 and 11 each consist of a plastic material with sputtered aluminum coating.

DETAILED DESCRIPTION OF THE INVENTION

To permit a controlled charge dissipation when electrostatic charging of the reflectors 8 and 11 occurs as the illuminating device 1 is brought in contact with the onboard electrical system of the vehicle there are charge dissipation means provided in accordance with this present invention.

In a first embodiment of the invention according to FIG. 1 there is a separate charge dissipation path 12 provided on a side of the lamp carrier 1 that is facing the reflector 11 which path is provided in the form of an electric charge dissipator integrated in a pressed screen of the lamp carrier 1. Said pressed screen moreover comprises further electric conductors for electrically connecting the bulbs 12 to a connection 13 of the lamp carrier 1. This electric connection 13 has a plurality of contact elements for electrical and mechanical coupling to a central plug connector arrangement with the aid of a central plug connector 14 that is in communication with the onboard electrical system of the vehicle.

The charge dissipation path 12 has a first end 15 electrically and mechanically connected with a wall section 17 of the reflector 11 via a spring contact connector element 16 which latter is made of an electrically conductive material and comprises a U-shaped area 18 for clamping it to said wall section 17 of the reflector 11. The spring contact element 16 also has a V-shaped section 19 which exerts pressure on said first end 15 of the charge dissipation means 12.

A second end 20 of the charge dissipator 12 is in communication with an earth connection M of the lamp carrier connection 13. The dissipation means establish a direct contact between the reflector 8 on one hand and the earth connection M of the lamp carrier 1 on the other hand.

Figure 3:
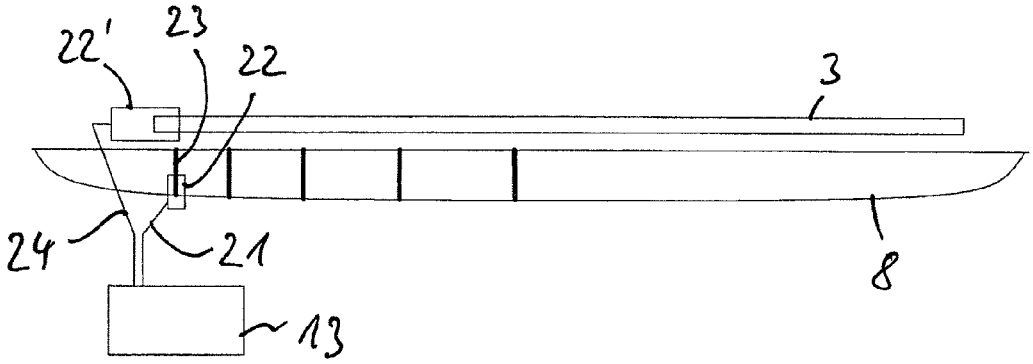
FIG. 3 is a section through the illuminating device in the area of a light element carrier with a charge dissipation path according to a second embodiment.

A second embodiment of the invention as per FIG. 3 provides for the charge dissipation path to be provided in the form of an electrically conductive cable 21 which extends in a space between the reflector 8 and an earth connection M of the lamp carrier connection 13 or the illuminating device. The earth connection M of the illuminating device is in this present exemplary embodiment integrated in the electrical connection 13 of the lamp carrier 1. A first end of said electrically conductive cable 21 is mechanically and electrically connected to a web-shaped wall member 23 of the reflector 8 by means of a plug connector element 22. As will be seen from FIG. 3, the electrically conductive cable 21 extends to the connection 13 of the lamp carrier 1 together with a power supply cable 24 for the printed board 2. The electrically conductive cable 21 and the power supply cable 24 may be crimped together. The power supply cable 24 is coupled to connecting tracks of the printed board 3 by means of an edge contact plug 22' just like the power supply cable 21 is.

Figure 4:
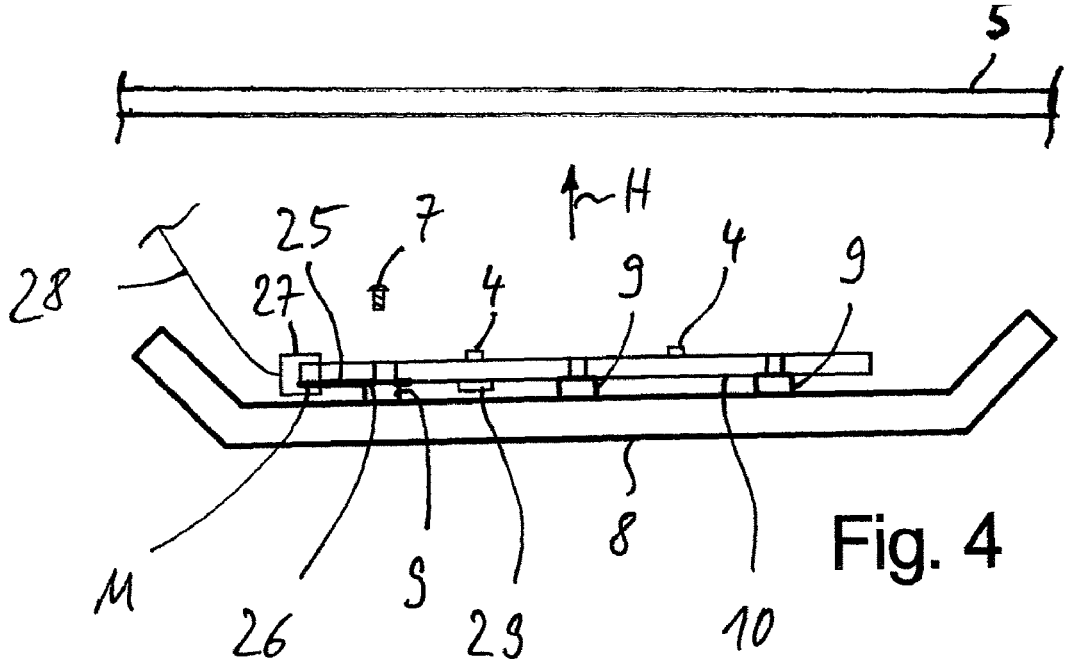
FIG. 4 a partial section through the illuminating device in the area of a light element carrier with a charge dissipation path according to a third embodiment.

Another embodiment of the invention as per FIG. 4 provides for a charge dissipation path to be in the form of a charge dissipation track 25 which extends on the rear 10 of the printed board 3 that is facing reflector 8. A first end of the charge dissipation track 25 is a land 26 extending in the area of a fixing bore 6 that faces a head end of the printed board 3. This land 26 is disposed annularly around the fixing bore 6. The printed board 3 has no copper coatings in the area of said land 26. Land 26 may be provided for instance by applying tin-lead solder just like the charge dissipation track as such.

The first end of the charge dissipation track 25 is hence disposed within a fixing area between printed board 3 and reflector 8 in which the fixing screw 7 is in threaded connection with the fixing pad 9 of the reflector 8 such that said pad 9 gets seated against a free end face of the land 26.

A second end of the charge dissipation track 25 is in communication with the earth connection M of the conductor tracks forming part of the circuit arrangement on printed board 3. In the area of the energy feed connection thus provided of the printed board 3 there is an end-face plug connector element 27 provided from which a power cable 28 is leading to the electric connection 13 of the lamp carrier 1.

This charge dissipation path 25 permits direct charge dissipation from the reflector 8 towards the earth connection M of a central plug connector arrangement such that no damage will be caused to any of the electronic components 29 arranged on the rear face 10 of the printed board 3 when an electrostatic discharge of the reflector 8 occurs.

According to a not-shown alternative embodiment the printed board may be exclusively used for activation of distant light sources (LED elements) and is for that purpose solely fitted with electronic components for activation and not with LED elements.

According to another alternative embodiment of the invention the illuminating device may also be in the form of a headlight or an interior light arranged inside the vehicle. The illuminating device of this present invention is adapted for use wherever metallic surfaces are existing that might lead to any undesirable electrostatic charging.

The invention claimed is:

1. An illuminating device for a vehicle, with
- at least one light source,
- a housing containing the at least one light source,
- a reflector,
- a support accommodating the light source and the reflector, and
- a diffusion lens for covering an opening of the housing,
- wherein the reflector is provided with an electrically conductive coating and is assigned a charge dissipation path in such a manner that, when electrostatic charging of the reflector occurs, a dissipation current flows via the charge dissipation path to an earth connection of the illuminating device.

2. An illuminating device for a vehicle, with at least one light source, a housing containing the at least one light source, a reflector, a support accommodating the light source and the reflector, and a diffusion lens for covering an opening of the housing, wherein the reflector is provided with an electrically conductive coating and is assigned a charge dissipation path in such a manner that, when electrostatic charging of the reflector occurs, a dissipation current flows via the charge dissipation path to an earth connection of the illuminating device, wherein the charge dissipation path is a charge dissipation path having a first end electrically connected to a wall section of the reflector and a second end in electrical communication with an earth connection of a carrier or an earth connection of a central plug connector arrangement of the illuminating device.

3. The illuminating device according to claim 2, wherein a first end of the charge dissipation path is electrically and mechanically coupled to said wall section of the reflector via a spring contact connector element or a plug connector element.

4. The illuminating device according to claim 2, wherein the charge dissipation path is an electric charge dissipator which forms a pressed screen together with further electric conductors that are integrated in a support in the form of a lamp carrier for at least one incandescent bulb.

5. The illuminating device according to claim 3, wherein the charge dissipation path is an electric charge dissipator which forms a pressed screen together with further electric conductors that are integrated in a support in the form of a lamp carrier for at least one incandescent bulb, and wherein the spring contact connector element comprises a U-shaped section for detachable connection with the reflector on one hand and a V-shaped section for communication with a first end of a charge dissipation path of a lamp carrier on the other hand.

6. The illuminating device according to claim 2, wherein the charge dissipation path is a charge dissipating track which extends on a printed board fitted with a plurality of LEDs as light sources.

7. The illuminating device according to claim 6, wherein a first end of the charge dissipating track is a land extending around a fixing bore of the printed board for accommodating a fixing means to attach the printed board to the reflector wherein a fixing element of said reflector is contacting said land at least partially.

8. The illuminating device according to claim 6, wherein the printed board is fitted with a plurality of electronic components on a side facing away from the LEDs.

9. The illuminating device according to claim 6, wherein the charge dissipation path is an electrically conductive cable which extends between a plug connector element detachably fixed to the reflector and the earth connection of the electric connection of the printed board or the earth connection of the central plug connector arrangement of the illuminating device.

10. The illuminating device according to claim 9, wherein at least one of the central plug connector arrangement of the illuminating device and the electric connection of the lamp carrier is arranged on a rear face of the housing.

11. A tail light for a vehicle, with at least one light source, a housing containing the at least one light source, a reflector, a support accommodating the light source and the reflector, and a diffusion lens for covering an opening of the housing, wherein the reflector is provided with an electrically conductive coating and is assigned charge dissipation path in such a manner that, when electrostatic charging of the reflector occurs, a dissipation current flows via the dissipation path to a ground connection of the illuminating device.

* * * * *